US007240964B2

(12) United States Patent
Riley

(10) Patent No.: US 7,240,964 B2
(45) **Date of Patent: *Jul. 10, 2007**

(54) UNIVERSALLY ADJUSTABLE SLIPCOVER FOR DINING ROOM CHAIRS

(75) Inventor: Paula Riley, New York, NY (US)

(73) Assignee: PRescient Partners, L.P., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/297,784

(22) Filed: Dec. 8, 2005

(65) Prior Publication Data

US 2006/0138820 A1 Jun. 29, 2006

Related U.S. Application Data

(63) Continuation of application No. 10/776,301, filed on Feb. 11, 2004, now Pat. No. 7,011,367.

(51) Int. Cl.
*A47C 31/11* (2006.01)

(52) U.S. Cl. ..... 297/229; 297/219.1; 297/228.1; 297/228.12

(58) Field of Classification Search ..... 297/219.1, 297/225, 228.1, 228.12, 229
See application file for complete search history.

(56) References Cited

U.S. PATENT DOCUMENTS

| | | | | | |
|---|---|---|---|---|---|
| 1,825,909 | A | * | 10/1931 | Levi | 297/224 |
| 1,836,302 | A | * | 12/1931 | Bloomfield | 297/229 |
| 2,179,805 | A | * | 11/1939 | Trubitz | 297/225 |
| 2,344,093 | A | * | 3/1944 | Kotowicz | 297/228.1 |
| 2,349,193 | A | * | 5/1944 | Pass | 297/225 |
| 2,522,404 | A | * | 9/1950 | Siebelist | 297/224 |
| 2,820,510 | A | * | 1/1958 | Sugarman | 297/228 |
| 2,937,695 | A | * | 5/1960 | Coggin | 297/227 |
| 4,676,549 | A | * | 6/1987 | English | 297/224 |

* cited by examiner

*Primary Examiner*—Peter R. Brown
(74) *Attorney, Agent, or Firm*—Notaro & Michalos P.C.

(57) ABSTRACT

A dining room chair slipcover arrangement has a pair of seat panels to cover each side of a seat while leaving an uncovered area. Each panel extends a full depth of the seat to a point below a front end of the seat. A chasuble covers the uncovered area of the seat and extends from a point below the front end of the seat, across the seat depth, up along a front surface of the back, across the top and down the rear surface of the back. Wrapping parts and connectors extending around the back for holding the chasuble to the chair. A skirt extends around the seat to cover sides of the seat and upper parts of the chair legs.

18 Claims, 5 Drawing Sheets

UNIVERSALLY ADJUSTABLE SLIPCOVER FOR DINING ROOM CHAIRS

CROSS-REFERENCE TO RELATED APPLICATION

This is a continuation of application Ser. No. 10/776,301 filed Feb. 11, 2004, which is incorporated here by reference, and is now U.S. Pat. No. 7,011,367.

FIELD AND BACKGROUND OF THE INVENTION

The present invention relates generally to the field of slipcovers, and in particular, to a new and useful slipcover for attractively and effectively covering dining room chairs, and more particularly, chairs with arms, and which can cover chairs having a wide range of sizes and shapes, and without the usual baggy unfitted look that is common for known dining room chair covers.

Covers for chairs are known, for example, from U.S. Pat. No. 1,820,104 to Whaley and U.S. Pat. No. 6,354,661 to Moss. Also see U.S. Design Patent D473,090 to Trucchi. To date, however, there has been no effective way of covering a dining room chair, particularly one which has arms. Even the known covers for chairs without arms tend to look baggy and unfitted. This is partly due to the wide range of sizes and shapes that dining room chairs come in.

The inventor here has found that generally dining room chairs have a seat that can be about 19 to 24 inches wide and about 19 to 27 inches deep. The chair back can rise to a height of about 36 to 44 inches from the floor and can be of many varies shapes. The height of the seat from the floor is a fairly predictable dimension of about 16 to 19 inches.

For dining room chairs with arms, the shapes, placements and sizes of the arms are even more varied. Generally, an upper horizontally extending part of each arm has a rear end connected to the back of the chair at about 7 to 9 inches above the seat. Each arm also generally has a vertically extending part at the front, with a low end connected at the side of the chair seat. This second connecting point can be anywhere from a point near the chair back, to a point near the front edge of the seat.

Any effective slipcover for this type of furniture must accommodate all of these variables and more, and the present invention has done so. The slipcover arrangement of the invention is not limited to chairs having arms, but can cover chairs without arms. Also, the slipcover arrangement of the invention can cover chairs having dimensions that are outside the ranges observed above.

SUMMARY OF THE INVENTION

It is an object of the present invention to provide a slipcover for a dining room chair which closely fits all parts of the chair regardless of its dimensions or shape, and whether the chair has arms or not.

Accordingly, another object of the invention is to provide a dining room chair slipcover arrangement for a dining room chair having a seat with a seat width and a seat depth, a back rising from a rear end of the seat and having a back width and a back height, and at least one, but usually four legs for maintaining the seat at a seat height, which arrangement comprises a pair of seat panels adapted to cover at least portions of each side of the seat while leaving an uncovered area on the seat between the seat panels in the direction of the seat width. Each seat panel has a length for extending a full seat depth from the back of a chair to be covered, to a point below a front end of the seat to be covered, a chasuble having a width to cover the uncovered area of the seat to be covered, and a total length for extending from a point below the front end of the seat to be covered, across the seat depth, up along a front surface of the back of the chair to be covered, across a top of the back and at least down part of a rear surface of the back and wrapping means connected to the chasuble for extending around at least part of the back for holding the chasuble over the seat panels and to the chair to be covered.

The seat panels each have a width of less than a minimum seat width for dining room chairs, and a length of more than a maximum seat depth for dining room chairs. Excess fabric is folded under at the rear end of the seat and draped down the sides and front of the seat. For covering chairs with arms, each seat panel includes at least one, but preferably two slits for receiving a portion of a dining room chair arm connected to the seat to be covered. The fabric between the slits is folded under the panel to make room for the arm.

The invention also may include a skirt for engaging around the seat to be covered and for extending from the seat down a portion of the seat height.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
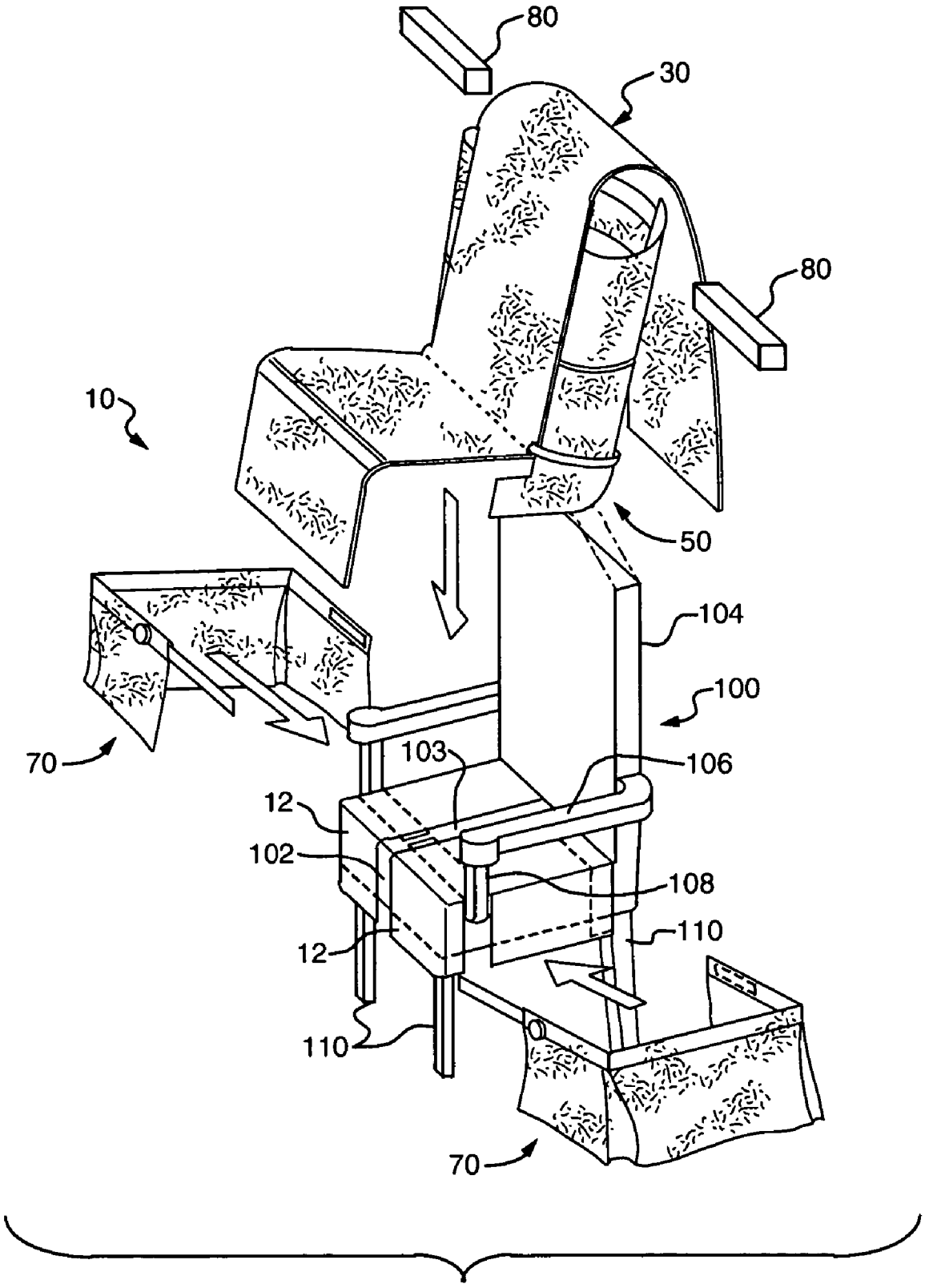
FIG. 1 is an exploded, perspective view of the dining room chair slipcover arrangement of the present invention with a dining room arm chair to be covered.

Referring now to the drawings, in which like reference numerals are used to refer to the same or similar elements, FIG. 1 illustrates a slipcover arrangement 10 for a dining room chair 100 that is universally adjustable to closely, attractively and securely cover a wide variety of dining room chair types, sizes and shapes, and importantly, accommodate chairs with arms as well as those without arms.

Chair 100 has a seat 102 with a seat width and a seat depth, a back 104 rising from a rear end of the seat 102 and having a back width and a back height, and at least one, but usually four legs 110 for maintaining the seat 102 at a seat height above the floor.

While appreciating the wide range of sizes and shapes of the chair seat and back, and also the varied possible placements of the chair arms, if arms are present, the slipcover arrangement of the invention comprises a pair of seat panels 12 made of fabric or other appropriate flexible material and adapted to cover at least portions of each side of the seat 102, while leaving an uncovered area 103 on the seat 102, between the seat panels 12 in the direction of the seat width. Each seat panel 12 has a length for extending a full seat depth from a back 104 of the chair 100, to a point below a front end of the seat 102 as shown in FIG. 1.

Figure 5:
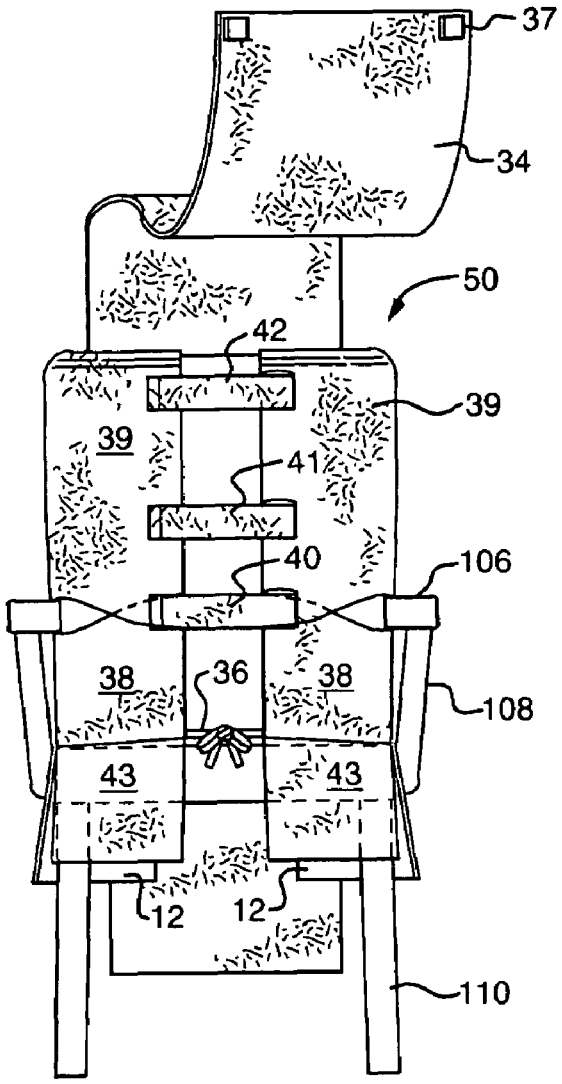
FIG. 5 is a rear elevational view of the arm chair with the arrangement partly engaged.
Figure 6:
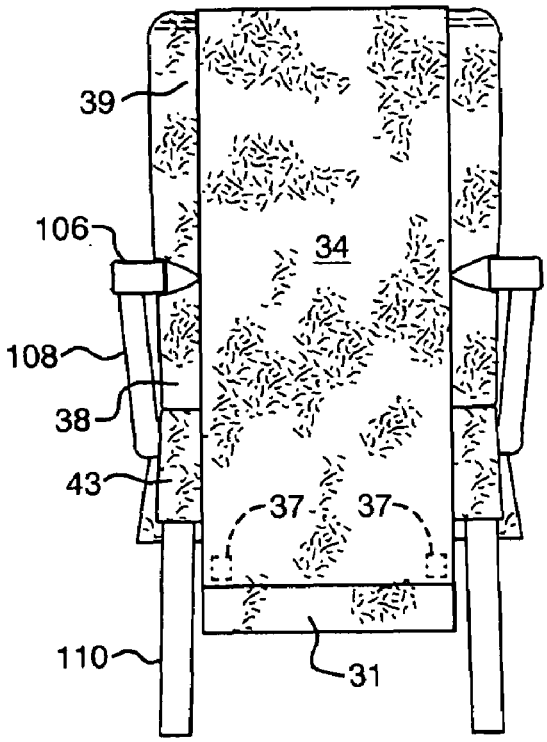
FIG. 6 is a view similar to FIG. 5 of a further position of the arrangement on the arm chair.

As also shown in FIG. 1, the arrangement includes a chasuble 30 of fabric or other appropriate material, having a width sufficient to fully cover the uncovered area 103 of the seat and parts of the side panels as well. The chasuble has a total length sufficient for extending from a point below the front end of the seat 102 (as shown in FIG. 5), across the seat depth, up along a front surface of the back 104 of the chair 100, across a top of the back and at least partly down a rear surface of the back (as shown in FIG. 6).

Wrapping means generally designated 50 and to be described in detail later in connection with a preferred embodiment of the invention, are connected to the chasuble 30 for extending around at least part of the back 104 for holding the chasuble 30 over the seat panels 12, 12, and to the chair 100 to be covered.

FIG. 1 also illustrates a pair of shoulders 80 which are made of foam rubber or other flexible resilient material that can be compressed. These shoulders are used as fillers in cases where the back 104 of chair 100 has a peaked or raised center shown in phantom line. I that case, shoulders 80 are placed on the top edge of chair back 104, on either side of the central peak and the chasuble 30 is wrapped over the chair back peak and shoulders to create a smooth, generally straight horizontal covering for the top edge of the chair back 104.

Figure 2:
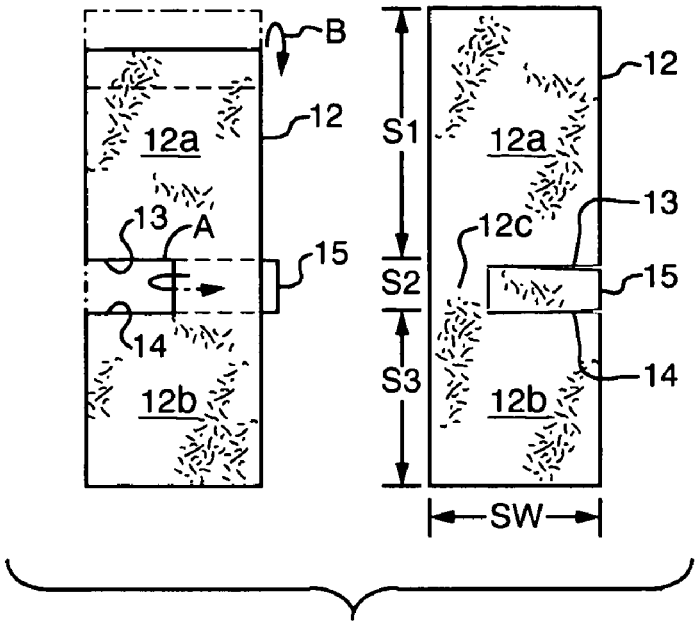
FIG. 2 is a top plan view of a pair of side panels of the arrangement.

With reference to FIG. 2, each seat panel 12 has a width SW of about 13 inches, or within the range of about 6 to 19 inches, but in any case, less than about the minimum seat width for dining room chairs. Each panel has a length of about 30 inches, or within the range of about 20 to 40 inches, but in any case, more than about the maximum seat depth for dining room chairs. Each seat panel also includes at least one slit, but preferable two spaced apart slits 13, 14. Slits 13, 14 define a fabric portion 15 therebetween which is folded under the rest of the panel in the direction of arrow A, as shown for the left panel 12 in FIG. 2, for receiving a front portion 108 of a dining room chair arm 106, that is connected to the seat 102 as shown in FIGS. 1 and 2. Slits 13 and 14 extend from left and right edges of the respective left and right side panels 12,12 to accommodate the chair arm 106 on each side of chair 100. Each slit 13, 14 and therefore the fabric portion 15, is about 6½ inches long to allow sufficient fabric to drape the sides of the seat 102.

Each side panel 12 has a rear portion 12*a* for covering the rear part of the side of the seat that is between the chair back 104 and the arm portion 108, with a length S1 of about 17 inches. This insures that all of the rear parts of the seat side behind the is arm is covered, even for the deepest seats. For less deep seats, rear portion 12*a* of the side panel 12 is folded under in the direction of arrow B in FIG. 2. A bridge portion 12*c* of each side panel between the slits 13 and 14, has a length S2 of about 2¾ inches to accommodate the arm portion 108. Front portion 12*b* of each side panel 12 has a length S3 of about 9½ to cover each front side part of the seat and leave enough fabric to drape down the front of the seat 102. The width SW of each panel is sufficient so that at least some of each side panel drapes down the sides of the seat after the side panel has been placed with the arm portion 108 in the deepest part of the space left by the folded back portion 15. FIG. 1 shows the placed, folded and draped positions for the side panels 12.

Figure 3:
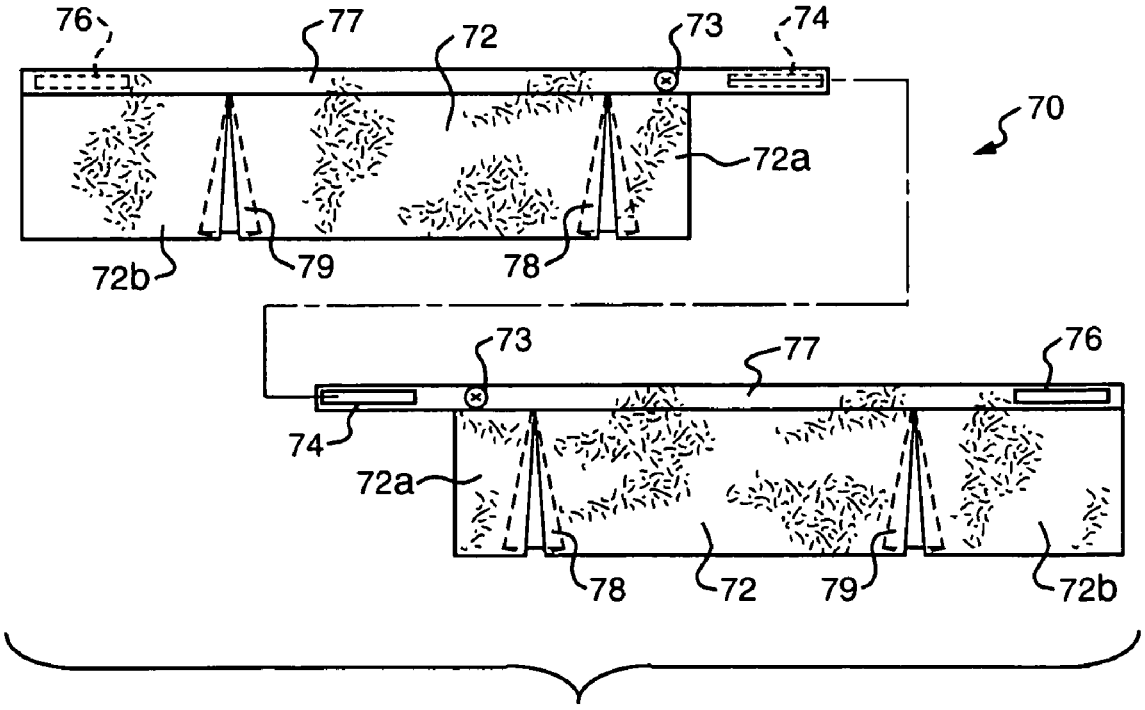
FIG. 3 is a side elevational view of a skirt of the arrangement.

A skirt 70, shown in two parts in FIGS. 1 and 3, is also provided for engaging around the seat 102 and for extending from the top of the seat, down the sides of the seat and further down a portion of the seat height to partly cover the legs 110. In the preferred embodiment of the invention, the skirt 70 defines a front gap G in FIG. 8, that is covered by a jumper portion of the chasuble 30 to be described later. In the alternative, the jumper portion of the chasuble is behind the skirt at the front of the chair so that the gap G is visible. For this embodiment of the invention, the edges of skirt 70 on either side of gap G are finished.

Figure 7:
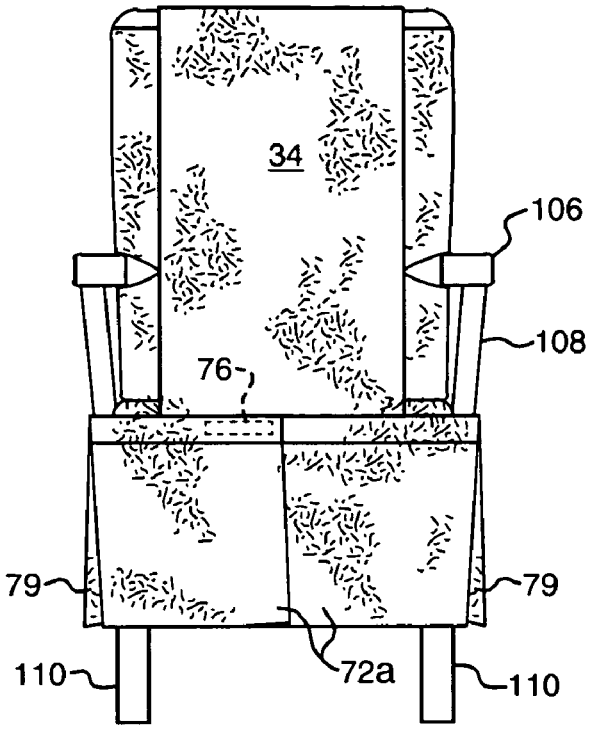
FIG. 7 is a view similar to FIG. 5 of a still further position of the arrangement on the arm chair.
Figure 8:
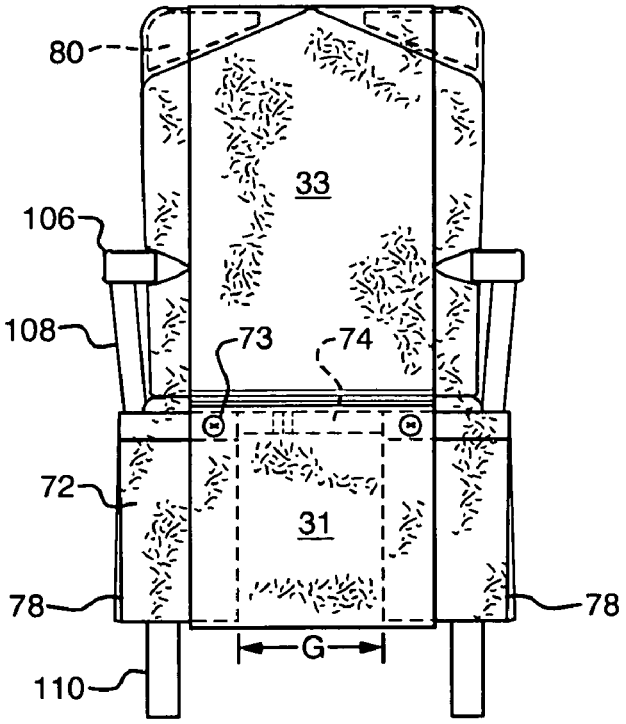
FIG. 8 is a view front elevational view of the invention fully covering the arm chair.

Returning to FIG. 3, the skirt 70 preferably comprises a pair of skirt portions 72, with a pair of front connectors 74 for connecting front parts 72*a* of the skirt portions to each other to form the gap G of FIG. 8. These front portions 72*a* of skirt 70 are either to be partly covered by the jumper portion as shown in FIG. 8, or they extend over the jumper portion. The skirt portions 72 also include a pair of rear connectors 76 for connecting rear parts 72*b* of the skirt portions to each other so that the skirt can be wrapped around the seat and tightly held in place as shown in FIGS. 7 and 8.

The width of gap G can vary depending on the width of the chair to be covered. This is done in the embodiment illustrated by providing the connectors 74 to be in the form of a pair of bands or ribbons each extending from an inner front end of the respective skirt portion 72. Each band has a length of mating hook-and-loop fastener tape, such as the VELCRO (a trademark) brand of fastener. The bands of the connectors 74 are made to overlap by a selected amount and the tapes are mated to hold the front parts of the skirt portions together. Each skirt portion 72 includes a box pleat or shirr of other interruption 78 at a location where the front leg will be to help frame and wrap the chair leg. In likewise fashion, each skirt portion 72 also includes a rear interruption 79 for framing or wrapping each rear leg. See FIGS. 7 and 8 as well.

Rather than spaced pleats 78, 79, each skirt portion can be shirred like a flounce along its entire length to attractively wrap the seat and legs.

The skirt portions 72 are each about 17 inches high and long enough to reach around any chair, e.g. about 46 inches, understanding that the gap G allows the combined length of the skirt portions to be less that the total circumference of a large dining room chair. Each skirt portion 72 also has an upper border 77 for the connectors 74 and 76 and from which the pleats or shirrs extend. A button or other fastener 73 is provided at the inner front end of each border for a purpose to be explained later in connection with the chasuble 30.

Figure 4:
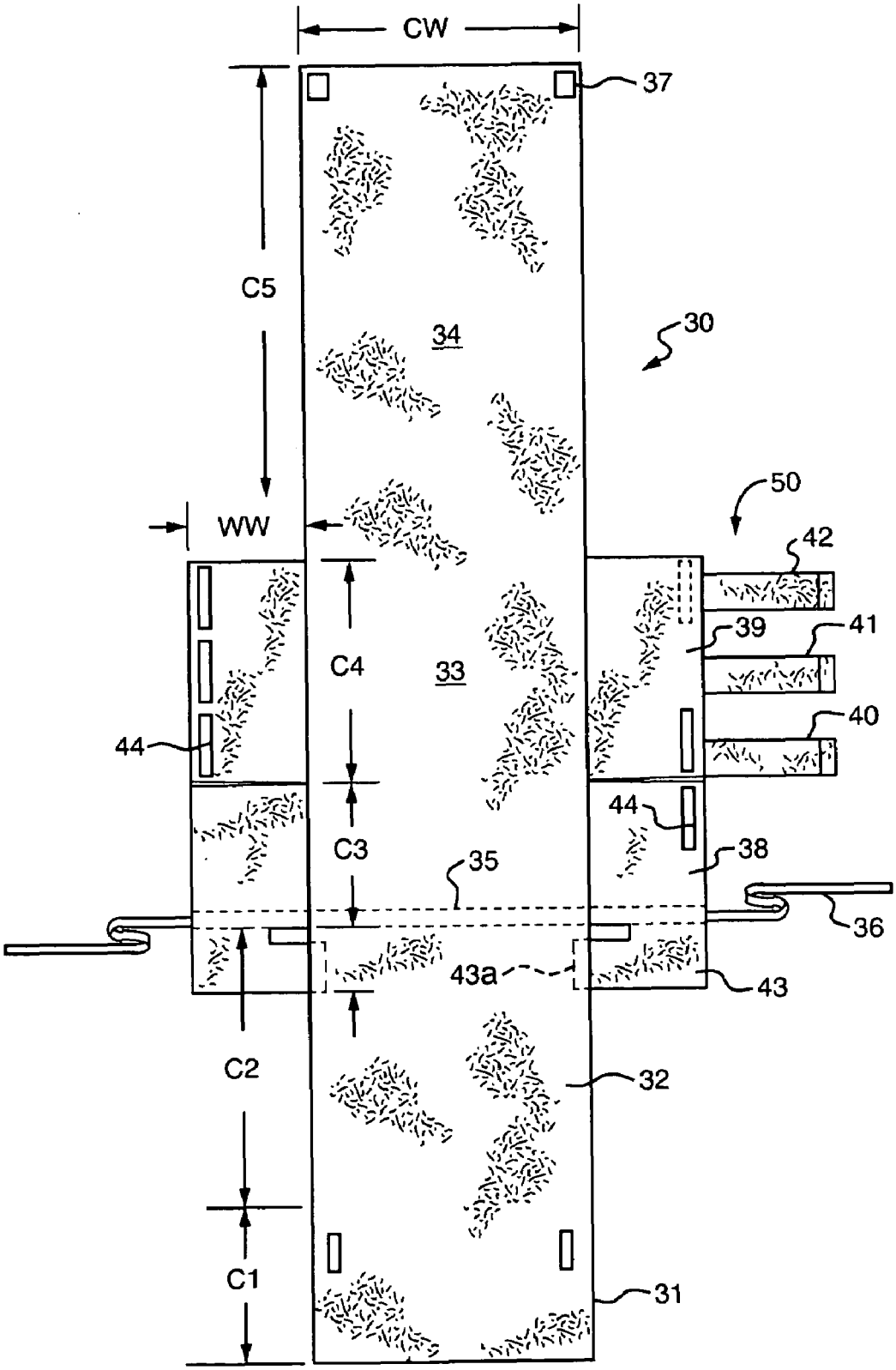
FIG. 4 is a top plan view of a chasuble of the arrangement.

Turning now to FIG. 4, the chasuble 30 comprises a central body that has a width CW of about 17 inches or within the range of about 14 to 20 inches wide and a total length of about 95 inches or within the range of about 80 to 110 inches. The central body includes a jumper portion 31 for covering a front of the chair, from the front end of the seat down to the point below the front end of the seat shown in FIG. 8. Jumper portion 31 has a preferred length C1 of about 18 inches, a seat portion 32 of length C2 of about 26 inches for extending across the seat depth, a first back portion 33 of length C3 plus C4 of about 26 inches for extending up along the front surface of the back of the chair and across the top of the back, and a second back portion 34 of length C5 of about 31 inches for extending down the rear surface of the back as shown in FIG. 6. A pair of weights 37 can be attached to the inner surface of the second back portion 34 to help smooth this part of the chasuble at the rear surface of the chair back.

The chasuble 30 also includes a waist 35 extending near a junction between the seat portion 32 and the first back portion 33, which contains a fabric tunnel that receives a wrapping band 36 in the form of an elastic cord or ribbon. Waist 35 is placed at the rear end of the seat, at the base of the chair back, and the band 36 wraps around the chair back and is tied, hook-and-loop fastened or otherwise connected as shown in FIG. 5, for securing the chasuble to the back of the chair.

The wrapping means 50 also preferably include pairs of side wings 38 and 39 extending from opposite sides of the first back portion 33 for wrapping around the back of the chair, and at least one connecter, but preferably three connecting tabs 40, 41 and 42 for connecting, by hook-and-loop tapes or other fasteners, the wings to each other at the rear surface of the back as shown in FIG. 5. One end of the lower tabs 40 and 41 can be permanently secured, e.g. by sewing to its wing, while the other end is removably connected to the other wing at a mating hook-and-loop pair. Since the dining room chair 100 to be covered can have a back 104 of widely different heights, the top connecting tab 42 should be detachably connected to both upper wings 39 and with long hook-and-loop tabs for a large range of vertical adjustment.

Any extra fabric of the first back portion 33 and the wrapped upper wings 42 at the top of the chair back, are simple folded rearwardly behind the chair and are covered by the second back portion 34 which is allowed to drape down over the connected wrapping means as seen be comparing FIG. 5, with the second back portion 34 still raised, to FIG. 6, with the second back portion 34 hanging down over the rear surface of the chair back. FIG. 8 also illustrates in phantom and dotted lines how the compressible shoulders 80 are squeezed on opposite sides of the chair back peak (if present) and under the chasuble that is wrapped there-over.

The lower wings 38 have a length C3 of about 7 inches to be under the point of connection of the chair arms 106 to the chair back 104. The upper wings 39 wrapping around an upper part of the back and the lower wings 38 engage around a lower part of the back so that the arm of the chair is accommodated between the upper and lower wings as shown in FIGS. 5–8.

The chasuble 30 also includes a corner portion 43, connected to, and extending downwardly from each lower wing 38 for extending around the rear corners of the seat and rear legs.

The upper and lower wings and the corner portions all have a width WW of about 9 inches, while the length C4 of the upper wings 39 are about 14 inches each. Each corner portion 43 also includes an overlapping part 43*a* that extends under the draped side panels to properly cover the rear corners of the seats and rear legs. Also, hook-and-loop tapes 44 at overlapping surfaces of the upper and lower wings 38, 39 as shown in FIG. 5, connect these overlapping parts to each other and help to closely wrap the rear ends of the arms 106.

The second back portion 34 may also be provided with a loop or tunnel (not shown) to receive one or both the wings 38 and/or 39 in the case where the chair back 104 is curved. This will help pull the second back portion 34 against the curved chair back.

When used on a chair with no arms, the inner edges of seat panels 12 and 12 may be fix to, i.e. sewn to, the outer edges of the seat portion 32 of chasuble 30 and no slits 13 or 14 are needed since the widths of the seat panels 12 will accommodate any chair seat width and no arms need be accommodated.

While a specific embodiment of the invention has been shown and described in detail to illustrate the application of the principles of the invention, it will be understood that the invention may be embodied otherwise without departing from such principles.

What is claimed is:

1. A slipcover arrangement for a dining room chair having a seat with a seat width and a seat depth, a back rising from a rear end of the seat and having a back width and a back height, and at least one leg for maintaining the seat at a seat height, the arrangement comprising:

a pair of seat panels each having a size adapted to cover different and opposite portions of a top of a seat to be covered while leaving an uncovered area on the seat between the seat panels in the direction of the seat width, each seat panel having a length for extending a full seat depth from the back of a chair to be covered, to a point below a front end of the seat to be covered, each seat panel having a width of less than the seat width and a length of more than the seat depth;

a chasuble having a width to cover the uncovered area of the seat to be covered, and a total length for extending from a point below the front end of the seat to be covered, across the seat depth, up along a front surface of the back of the chair to be covered, across a top of the back and at least down part of a rear surface of the back;

wrapping means connected to the chasuble for extending around at least part of the back for holding the chasuble over the seat panels and to the chair to be covered; and a skirt for engaging around the seat to be covered and for extending from the seat down a portion of the seat height, the skirt defining a front gap that is covered by a jumper portion of the chasuble.

2. The slipcover of claim 1, wherein each seat panel includes at least one slit for receiving a portion of a dining room chair arm connected to the seat to be covered.

3. The slipcover of claim 1, wherein the chasuble comprises a jumper portion for covering a front of the chair to be covered from the front end of the seat down to the point below the front end of the seat to be covered, a seat portion for extending across the seat depth, a first back portion for extending up along the front surface of the back of the chair to be covered and across the top of the back, and a second back portion for extending down a rear surface of the back.

4. The slipcover of claim 3, wherein the chasuble has a waist extending near a junction between the seat portion and the first back portion, the wrapping means includes a band at the waist for securing the waist of the chasuble to the back of the chair to be covered.

5. The slipcover of claim 3, wherein the chasuble includes a pair of side wings extending from opposite sides of the first back portion for wrapping around the back of the chair to be covered, and at least one connecter for connected the wings to each other at the rear surface of the back, the second back portion being adapted to cover the connected wings at the rear surface of the back.

6. The slipcover of claim 5, wherein each side wing comprises an upper wing for wrapping around an upper part of the back and a lower wing for engaging around a lower part of the back so that an arm of the chair to be covered which is connected to the back is accommodated between the upper and lower wings, and connectors for connecting the upper wings to each other and for connecting the lower wings to each other.

7. The slipcover of claim 6, wherein the chasuble includes a corner portion connected to, and extending downwardly from each lower wing for extending around rear corners of the seat to be covered.

8. The slipcover of claim 1, wherein the wrapping means comprise a plurality of elastic tabs for connecting portions of the chasuble that are wrapped around to the rear surface of the back, the chasuble being sufficiently long so that a portion of the chasuble covers the tabs at the rear surface of the back.

9. The slipcover of claim 1, wherein the pair of seat panels are fixed to opposite sides of a seat portion of the chasuble.

10. A slipcover arrangement for a dining room chair having a seat with a seat width and a seat depth, a back rising from a rear end of the seat and having a back width and a back height, and at least one leg for maintaining the seat at a seat height, the arrangement comprising:

a pair of seat panels each having a size adapted to cover different and opposite portions of a top of a seat to be covered while leaving an uncovered area on the seat between the seat panels in the direction of the seat width, each seat panel having a length for extending a full seat depth from the back of a chair to be covered, to a point below a front end of the seat to be covered, each seat panel having a width of less than the seat width and a length of more than the seat depth;

a chasuble having a width to cover the uncovered area of the seat to be covered, and a total length for extending from a point below the front end of the seat to be covered, across the seat depth, up along a front surface of the back of the chair to be covered, across a top of the back and at least down part of a rear surface of the back;

wrapping means connected to the chasuble for extending around at least part of the back for holding the chasuble over the seat panels and to the chair to be covered; and a skirt for engaging around the seat to be covered and for extending from the seat down a portion of the seat height, the skirt comprising a pair of skirt portions with a pair of front connectors for connecting front parts of the skirt portions to each other to form a gap, the gap being covered by a jumper portion of the chasuble, and a pair of rear connectors for connecting rear parts of the skirt portions.

11. A slipcover arrangement for a dining room chair having a seat with a seat width and a seat depth, a back rising from a rear end of the seat and having a back width and a back height, and at least one leg for maintaining the seat at a seat height, the arrangement comprising:

a pair of seat panels each having a size adapted to cover different and opposite portions of a top of a seat to be covered while leaving an uncovered area on the seat between the seat panels in the direction of the seat width, each seat panel having a length for extending a full seat death from the back of a chair to be covered, to a point below a front end of the seat to be covered, each seat panel having a width of less than the seat width and a length of more than the seat depth;

a chasuble having a width to cover the uncovered area of the seat to be covered, and a total length for extending from a point below the front end of the seat to be covered, across the seat depth, up along a front surface of the back of the chair to be covered, across a top of the back and at least down part of a rear surface of the back;

wrapping means connected to the chasuble for extending around at least part of the back for holding the chasuble over the seat panels and to the chair to be covered; and a skirt for engaging around the seat to be covered and for extending from the seat down a portion of the seat height, the skirt defining a front gap that is spanned by a jumper portion of the chasuble.

12. The slipcover of claim 11, including connectors for connecting the jumper portion of the chasuble to the skirt on opposite sides of the gap.

13. A slipcover arrangement for a dining room chair having a seat with a seat width and a seat depth, a back rising from a rear end of the seat and having a back width and a back height, and at least one leg for maintaining the seat at a seat height, the arrangement comprising:

a pair of seat panels each having a size adapted to cover different spaced apart side portions of tops of a seat to be covered while leaving an uncovered area on the seat between the seat panels in the direction of the seat width, each seat panel having a length for extending a full seat depth from the back of a chair to be covered, to a point below a front end of the seat to be covered;

a chasuble having a width to cover the uncovered area of the seat to be covered, and a total length for extending from a point below the front end of the seat to be covered, across the seat depth, up along a front surface of the back of the chair to be covered, across a top of the back and down a rear surface of the back;

wrapping means connected to the chasuble for extending around at least part of the back for holding the chasuble over the seat panels and to the chair to be covered;

each seat panel have a width of less than the seat width, and a length of more than the seat depth, each seat panel includes at least one slit for receiving a portion of a dining room chair arm connected to the seat to be covered;

a skirt for engaging around the seat to be covered and for extending from the seat down a portion of the seat for holding the chasuble and the side panels to the chair; and the skirt defining a front gap that is covered by a jumper portion of the chasuble.

14. The slipcover of claim 13, wherein the skirt comprises a pair of skirt portions with a pair of front connectors for connecting front parts of the skirt portions to each other to form the gap covered by the jumper portion and a pair of rear connectors for connecting rear parts of the skirt portions to each other.

15. The slipcover of claim 14, wherein the chasuble comprises the jumper portion for covering a front of the chair to be covered from the front end of the seat down to the point below the front end of the seat to be covered, a seat portion for extending across the seat depth, a first back portion for extending up along the front surface of the back of the chair to be covered and across the top of the back, and a second back portion for extending down a rear surface of the back.

16. The slipcover of claim 15, wherein the chasuble has a waist extending near a junction between the seat portion and the first back portion, the wrapping means include a band at the waist for securing the waist of the chasuble to the back of the chair to be covered.

17. The slipcover of claim 16, wherein the chasuble includes a pair of side wings extending from opposite sides of the first back portion for wrapping around the back of the chair to be covered, and at least one connecter for connecting the wings to each other at the rear surface of the back, the second back portion being adapted to cover the connected wings at the rear surface of the back.

18. The slipcover of claim 17, wherein each side wing comprises an upper wing for wrapping around an upper part of the back and a lower wing for engaging around a lower part of the back, so that an arm of the chair to be covered which is connected to the back is accommodated between the upper and lower wings, and connectors for connecting the upper wings to each other and for connecting the lower wings to each other, the chasuble including a corner portion connected to, and extending downwardly from each lower wing for extending around rear corners of the seat to be covered.

* * * * *